US009968815B2

(12) United States Patent
Malmqvist

(10) Patent No.: US 9,968,815 B2
(45) Date of Patent: May 15, 2018

(54) DEVICE FOR PHYSICAL EXERCISE

(75) Inventor: Stig Malmqvist, Junsele (SE)

(73) Assignee: Stig Malmqvist, Junsele (SE)

( * ) Notice: Subject to any disclaimer, the term of this patent is extended or adjusted under 35 U.S.C. 154(b) by 69 days.

(21) Appl. No.: 13/983,080

(22) PCT Filed: Feb. 2, 2012

(86) PCT No.: PCT/SE2012/050100

§ 371 (c)(1),
(2), (4) Date: Aug. 1, 2013

(87) PCT Pub. No.: WO2012/105902

PCT Pub. Date: Aug. 9, 2012

(65) Prior Publication Data

US 2013/0303347 A1 Nov. 14, 2013

(30) Foreign Application Priority Data

Feb. 4, 2011 (SE) ..... 1150079

(51) Int. Cl.
*A63B 21/00* (2006.01)
*A63B 21/012* (2006.01)
(Continued)

(52) U.S. Cl.
CPC .. *A63B 21/00029* (2013.01); *A63B 21/00069* (2013.01); *A63B 21/0087* (2013.01);
(Continued)

(58) Field of Classification Search
CPC . A63B 21/012; A63B 21/0125; A63B 21/015; A63B 22/0002; A63B 22/001;
(Continued)

(56) References Cited

U.S. PATENT DOCUMENTS 1,432,013 A 10/1922 Blake
2,832,334 A * 4/1958 Whitelaw ..... A63B 23/14 482/118

(Continued)

FOREIGN PATENT DOCUMENTS

GB 2337468 11/1999
GB 2461072 12/2009

(Continued)

OTHER PUBLICATIONS

International search report for PCT/SE2012/050100 dated Apr. 16, 2012.
Written Opinion for PCT/SE2012/050100 dated Apr. 16, 2012.

*Primary Examiner* — Nyca T Nguyen
(74) *Attorney, Agent, or Firm* — Calfee, Halter & Griswold LLP

(57) ABSTRACT

A training equipment for resistance training of the upper body, wherein the training equipment comprises: an attachment portion adapted to be attached to the body of an exercising person, a handle portion adapted to be gripped by the exercising person, a first distance device flexibly attached in the attachment portion by a first joint, a second distance device flexibly attached in the first distance device by a second joint. At least one of: the first joint, the second joint, the first distance device, and the second distance device comprises an adjustable movement resistance device adapted to create an adjustable resistance between the attachment portion and the handle portion, so that training of the upper body is obtained upon movement of the handle portion.

10 Claims, 6 Drawing Sheets

(51) Int. Cl.

| | |
|---|---|
| ***A63B 21/015*** | (2006.01) |
| ***A63B 69/00*** | (2006.01) |
| ***A63B 69/18*** | (2006.01) |
| ***A63B 21/008*** | (2006.01) |
| ***A63B 23/12*** | (2006.01) |
| ***A63B 22/06*** | (2006.01) |
| ***A63B 23/035*** | (2006.01) |
| ***A63B 22/00*** | (2006.01) |

(52) U.S. Cl.

CPC ..... *A63B 21/015* (2013.01); *A63B 21/157* (2013.01); *A63B 21/4009* (2015.10); *A63B 21/4025* (2015.10); *A63B 21/4035* (2015.10); *A63B 21/4047* (2015.10); *A63B 22/0005* (2015.10); *A63B 22/0664* (2013.01); *A63B 23/03541* (2013.01); *A63B 23/1263* (2013.01); *A63B 69/0028* (2013.01); *A63B 69/182* (2013.01); *A63B 21/4045* (2015.10); *A63B 2209/02* (2013.01); *A63B 2225/09* (2013.01); *A63B 2225/093* (2013.01)

(58) Field of Classification Search

CPC ..... A63B 22/0012; A63B 23/1263; A63B 69/182; A63B 69/0022; A63B 21/065; A63B 21/4025; A63B 21/0087; A63B 23/0417; A63B 22/0005; A63B 22/0015; A63B 22/0017; A63B 21/00181; A63B 21/00085; A63B 21/40; A63B 21/4001; A63B 21/4023; A63B 23/1254; A63B 23/12; A63B 23/1209; A63B 23/1245; A63B 23/129; A63B 23/02

USPC ..... 482/95, 135

See application file for complete search history.

(56) References Cited

U.S. PATENT DOCUMENTS

| | | | | | |
|---|---|---|---|---|---|
| 3,941,377 | A | | 3/1976 | Lie | |
| 4,441,707 | A | | 4/1984 | Bosch | |
| 4,772,015 | A | * | 9/1988 | Carlson et al. | 482/92 |
| 4,986,537 | A | * | 1/1991 | D'Orta | A63B 21/00178 482/105 |
| 5,042,799 | A | * | 8/1991 | Stanley | 482/123 |
| 5,213,094 | A | * | 5/1993 | Bonutti | 601/33 |
| 5,215,508 | A | * | 6/1993 | Bastow | A63B 23/08 482/112 |
| 5,337,737 | A | * | 8/1994 | Rubin | A63B 23/1281 128/898 |
| 5,419,747 | A | * | 5/1995 | Piaget | A63B 22/001 434/255 |
| 5,423,729 | A | | 6/1995 | Eschenbach | |
| 5,433,688 | A | | 7/1995 | Davies | |
| 5,618,249 | A | | 4/1997 | Marshall | |
| 5,683,336 | A | | 11/1997 | Pape | |
| 5,688,137 | A | | 11/1997 | Bustance | |
| 5,820,533 | A | | 10/1998 | Goldman | |
| 5,865,714 | A | * | 2/1999 | Marlowe | 482/112 |
| 5,980,435 | A | * | 11/1999 | Joutras et al. | 482/114 |
| 6,059,697 | A | | 5/2000 | Breems | |
| 6,280,365 | B1 | | 8/2001 | Weber et al. | |
| 7,147,590 | B2 | | 12/2006 | Toven | |
| 7,297,090 | B2 | * | 11/2007 | Torres | A63B 21/015 482/124 |
| 2002/0193207 | A1 | * | 12/2002 | Wang | F16H 57/0434 477/157 |
| 2003/0060341 | A1 | * | 3/2003 | Brasel | A63B 21/0023 482/91 |
| 2003/0125170 | A1 | * | 7/2003 | Vernon | A63B 21/0442 482/124 |
| 2004/0033868 | A1 | * | 2/2004 | Van Straaten | A63B 21/005 482/110 |
| 2004/0053755 | A1 | * | 3/2004 | Wilkinson | 482/124 |
| 2005/0261113 | A1 | * | 11/2005 | Wilkinson | A63B 21/0004 482/124 |
| 2007/0037676 | A1 | * | 2/2007 | DeNisco | A61H 1/0244 482/112 |
| 2007/0117683 | A1 | * | 5/2007 | Ercanbrack et al. | 482/52 |
| 2011/0021962 | A1 | * | 1/2011 | Sorrenti | A61F 5/3753 602/20 |
| 2012/0040807 | A1 | * | 2/2012 | Chen et al. | 482/121 |
| 2012/0101420 | A1 | * | 4/2012 | Albrecht | A61F 5/3753 602/20 |
| 2012/0264576 | A1 | * | 10/2012 | Goeckel | 482/124 |

FOREIGN PATENT DOCUMENTS

| | | |
|---|---|---|
| WO | 9406518 | 3/1994 |
| WO | 2003057320 | 7/2003 |

* cited by examiner

DEVICE FOR PHYSICAL EXERCISE

CROSS-REFERENCE TO RELATED APPLICATION

This application is the U.S. national phase entry of PCT/SE2012/050100, with an international filing date of 2 Feb. 2012, which claims the benefit of Swedish patent application no. 1150079-0, with a filing date of 4 Feb. 2011, the entire disclosure of which is fully incorporated herein by reference.

TECHNICAL FIELD

The present invention relates generally to training equipment, and more specifically to training equipment for use during walk- or running training.

BACKGROUND

To activate the upper body during walk- or running training increases the training effect considerably. Activation of the arms involves several muscle groups in the upper body, as arms, shoulders and back. Since more muscles need to be oxygenated the cardiac stress increases which enhances the condition effect of the training at the same as the upper body is strength trained.

According to Gullstrand and Svedenhag the oxygen uptake, pulse and lactic acid in blood was 16.5; 8.8 and 20.5% higher during pole walking which activates the upper body in comparison to normal walking which does not activate the upper body (Gullstrand, L; Svedenhag, J *Träningseffekter efter sju veckors stavgångs-och vanlig gångträning*; Elitidrottscentrum, Bosön Lidingö, 2001), and according to Karlsson and Knuttson as much as 50% higher oxygen uptake and 30% higher pulse (Karlsson, Ronny; Knutsson, Monika Stavgång—träning för hela kroppen, 2001).

Different types of training equipment for condition training and strength training of both legs and upper body have been available for a long time. The most commonly occurring training equipment today for this purpose is the so-called cross-trainer, for instance described in U.S. Pat. No. 5,423,729: Collapsible exercise machine with arm exercise. The cross-trainer is a stationary training equipment which advantageously is used in-house and combines an elliptical running or cycling movement with a pivoting arm movement.

Another example of a stationary training equipment that combines training for legs with training for upper body is found in U.S. Pat. No. 3,941,377: Apparatus for simulated skiing, which equipment statically aims at imitating cross-country skiing.

Walking poles is an alternative equipment for non-stationary training which activates the upper body. Pole walking is a well-used training-form among elite cross-country skiers who then during the summer time partly can replicate the movement pattern that occur during skiing. Walking poles have usually an adjustably fixed length which make them only suitable for walking when the person is not as much moving up and down vertically. The fixed length of the pole makes it difficult to use walking poles during running training. Further are walking poles difficult to use in some terrains.

SUMMARY

Training equipment for resistance training is shown. The training equipment comprises: an attachment portion adapted for being attached to the body of an exercising person, a handle portion adapted to be gripped by the person who trains, a first spacer device flexibly or articulatedly attached in the attachment portion by a first joint, and a second spacer device flexibly or articulatedly attached in the first spacer device by a second joint. Further comprises at least one of: the first joint, the second joint, the first spacer device, and the second spacer device an adjustable resistance function adapted for creating an adjustable movement resistance between the attachment portion and the handle portion so that training of the upper body is obtained by movement of the handle portion.

The adjustment of the movement resistance enables an adjustment between either in particular increasing the condition part of the training, alternatively in particular increase the strength training of several muscle groups in the upper body, as arms, shoulders, and back.

According to one embodiment of the training equipment at least one of: the first joint, the second joint, the first spacer device, and the second spacer device is adapted for creating varying movement resistance over a movement cycle so that different amounts of training of the upper body is obtained at different phases in the movement cycle. A varying movement resistance can for instance be advantageous to train poling skiing more focused.

According to one embodiment the training equipment further comprises a waist belt adapted for attachment around the person who will exercise, wherein the attachment portion is fixed to the waist belt.

According to one embodiment, the length is at least one of: the first spacer device, and the second spacer device adjustable, so that the training equipment can be adapted to the exercising person.

According to one embodiment the movement resistance device is at least one of: a movement resistance device based on friction, and a movement resistance device based on pneumatic pressure.

Further is a training equipment for resistance training of the upper body shown comprising: an attachment portion adapted for being attached to the body of an exercising person, a handle portion adapted to be gripped by the exercising person, a first spacer device flexibly attached in the attachment portion by a first joint, and a second spacer device flexibly attached in the first spacer device by a second joint. At least one of: the first joint, the second joint, the first spacer device, and the second spacer device is adapted for creating varying movement resistance over a movement cycle so that different amounts of training of the upper body is obtained at different phases in the movement cycle. A varying movement resistance can for instance be advantageous to train poling skiing more focused.

According to one embodiment, comprises at least one of: the first joint, the second joint, the first spacer device, and the second spacer device an adjustable resistance function adapted for creating an adjustable movement resistance device between the attachment portion and the handle portion so that training of the upper body is obtained by movement of the handle portion.

According to one embodiment the training equipment further comprises a waist belt adapted for attachment around the person who will exercise, wherein the attachment portion is fixed to the waist belt.

According to one embodiment, the length of at least one of: the first spacer device, and the second spacer device is adjustable, so that the training equipment can be adapted to the exercising person.

According to one embodiment the movement resistance device is at least one of: a movement resistance device based on friction, and a movement resistance device based on pneumatic pressure.

It should be noted that the invention can be freely combined within the scope of the patent claims.

BRIEF DESCRIPTION OF DRAWINGS

The invention is now further described below, by the aid of the attached embodiments, with reference to the accompanying drawings, in which.

DESCRIPTION OF EMBODIMENTS

Figure 1:
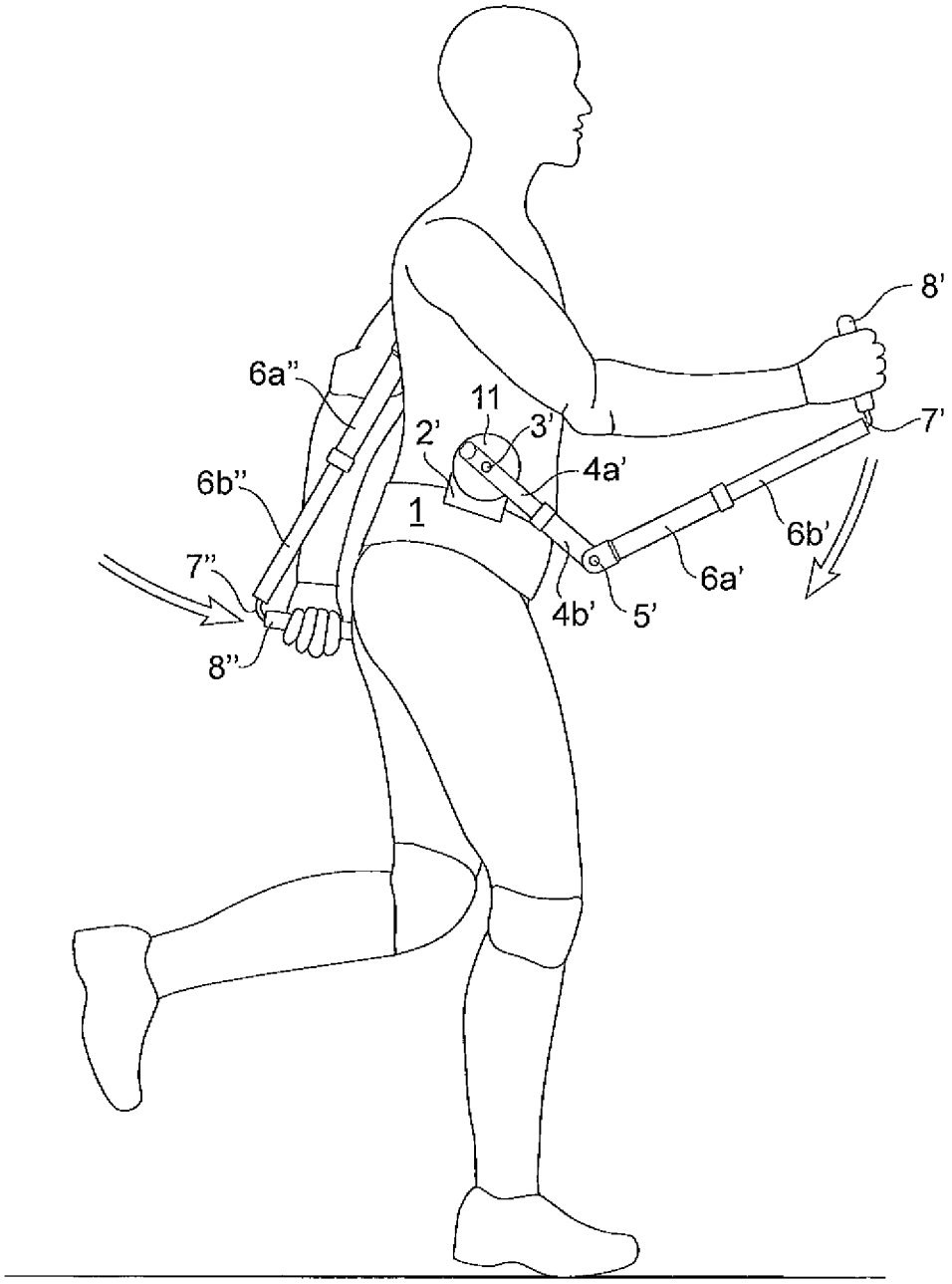
FIG. 1 shows the training equipment according to a first embodiment fixed to the waist of an exercising person in its first position.

In the following, a detailed description of embodiments will be shown with reference to the accompanying drawings. It will be appreciated that these figures are for illustration of embodiments only and are not in any way restricting the scope of protection. Directional indications should be seen as directional indications in the drawings. Prime (') is intended to indicate that the described part is adapted to be located on the exercising person's right side, whereas bis (") is intended to indicate that the described part is adapted to be located on the exercising person's left side during use.

By the usage of the training equipment according to the present invention the upper body is activated during walk or running which increases the training effect considerably. The adjustment of the movement resistance enables an adjustment between either in particular increasing the condition part of the training, alternatively in particular increasing the strength training of several muscle groups in the upper body, as arms, shoulders, and back. The adjustment of the resistance also enables adapting of the training equipment to the exercising person, to the actual distance and/or the terrain. The adjustment of the resistance also enables adapting of the training equipment to different types of training, such as stake training, for instance by that the resistance can vary over the movement.

FIG. 1 shows a training equipment for resistance training of the upper body according to a first embodiment fixed to the waist of an exercising person. The training equipment comprises an attachment portion 2' adapted to be fixed to the body of an exercising person, for instance as shown in FIG. 1 with the aid of a waist belt 1. A first distance device 4*a*', 4*b*' is flexibly attached in the attachment portion 2' by a first joint 3', a second distance device 6*a*', 6*b*' is flexibly attached in the first distance device by a second joint 5'. The training equipment according to the embodiment shown in FIG. 1 comprises an adjustable movement resistance device 11 in the form of a friction creating circular disc. Further, the training equipment comprises a handle portion 8 adapted to be gripped by the exercising person. The friction creating disc 11 is adapted for creating an adjustable movement friction between the attachment portion 2' and the handle portion 8' so that training of the upper body is obtained by movement of the handle portion 8'.

The waist belt 1 can for instance be adjustable and/or elastic to provide stable support for the training equipment during use. The attachment portion 2' is for example made of a rigid material, such as a rigid polymeric material or metal such as aluminium and creates according to the embodiment shown in FIG. 1 a distance between the body of the exercising person and the movable joint 3' so that required space for the movement is obtained.

The first 4*a*'; 4*b*' and the second 6*a*'; 6*b*' distance device comprises according to the embodiment shown in FIG. 1*a* second portion 4*b*'; 6*b*' that is telescopically insertable in a first portion 4*a*'; 6*a*', which enables an adjustment of the length of the first 4*a*'; 4*b*' and the second 6*a*'; 6*b*' distance device which is required for adapting the training equipment to the exercising person. According to other embodiments of the training equipment (not shown) the telescopic function of the distance devices (4*a*'; 4*b*', 6*a*'; 6*b*') can further be used for creating a movement resistance for example by the creation of friction or pressure resistance, such as pneumatic pressure resistance, is created by movement between the first 4*a*'; 6*a*' and the second 4*b*'; 6*b*' portions of the distance devices. The advantage of pneumatic pressure resistance is that it does not generate any considerable heat. In further alternative embodiments the second joint 5' comprises a movement resistance that complements or replaces the movement resistance device 11 in the first joint 3' and/or in the distance devices 4*a*'; 4*b*', 6*a*'; 6*b*'.

The handle portion 8' is according to the embodiment shown in FIG. 1 attached in the second portion 6*b*' of the second distance device 6*a*'; 6*b*' by a flexible and/or elastic attachment device 7' adapted for enabling a natural hand position through the entire movement.

According to certain embodiments the movement resistances are adapted to create a varying resistance over the movement. A varying movement resistance can for instance be advantageous to train poling skiing more focused wherein a movement pattern is aimed for that is heavier in the beginning and the end of the movement. Alternatively, the movement resistance device can be adapted to only provide resistance in one direction, preferably corresponding to the poling movement which provides a force in a forward direction. The adaptation to only give resistance in one direction can for example be obtained by the aid of a ratchet function in the movement resistance device (corresponding to the function in for instance ratchet keys).

According to certain embodiments the training equipment is adapted for providing an increasing resistance at an increasing force and/or increasing speed, for instance for automatically adjusting the training based on the exercising person and/or based on the exercising person's physical status at that time and/or the terrain. The increasing resistance can for instance be achieved by the aid of a linear or non-linear dampener arranged as a movement resistance device in the distance devices, alternatively by that a material with viscoelastic properties is used as a movement resistance device at the first 3' and/or second joint 5'.

FIG. 1 shows the training equipment when the right portion of the training equipment is in its forward position on the way backward which is intended to correspond to the phase whereby the pole is set in the ground/snow, while the left portion of the training equipment (shown by the second distance device 6*a*"; 6*b*", attachment device 7" and the handle portion 8") is in its rear position on the way forward which is intended to correspond to the phase whereby the pole is brought back to its forward position. In embodiments wherein the training equipment is adapted for providing different amount of resistance at different positions the position of the right portion should be in a position in which the movement resistance is large enough to correspond to the force needed for pushing at the beginning of a poling movement, whereas the movement resistance for the left portion should be small or low to correspond to the little force required for bringing back the pole to its forward position.

Figure 2:
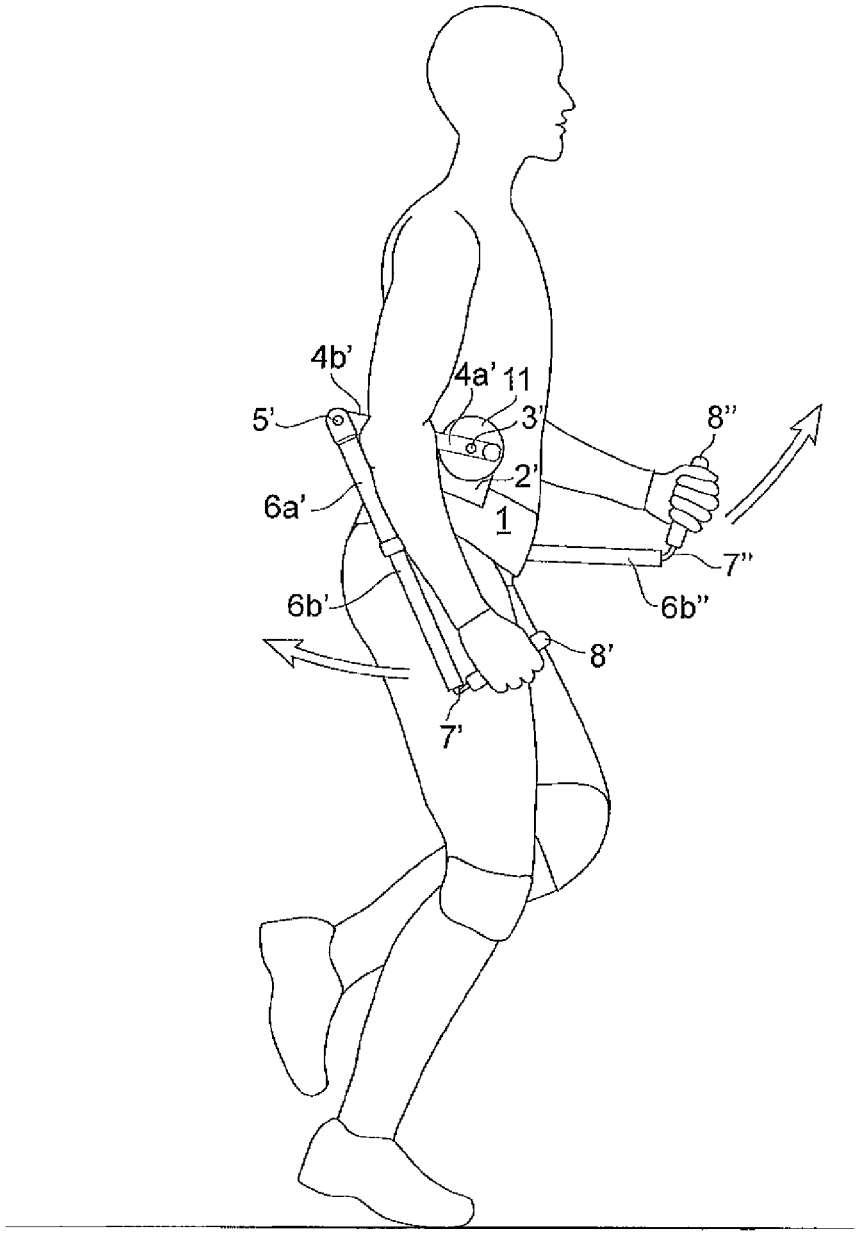
FIG. 2 shows the training equipment according to a first embodiment fixed to the waist of an exercising person in its second position.

FIG. 2 shows the training equipment according to FIG. 1 wherein the right portion of the training equipment is in its second position which is intended to correspond to the phase wherein the pole is used for pushing, whereas the left portion is on its way towards its forward position. In embodiments, wherein the training equipment is adapted for providing different amount of resistance at different positions the position of the right portion shown in FIG. 2 should be in a position in which the movement resistance is large enough to correspond to the force needed for pushing at the end of a stake movement, whereas the movement resistance for the left portion should be small or low to correspond to the small force required for bringing back the pole to its forward position.

Figure 3A:
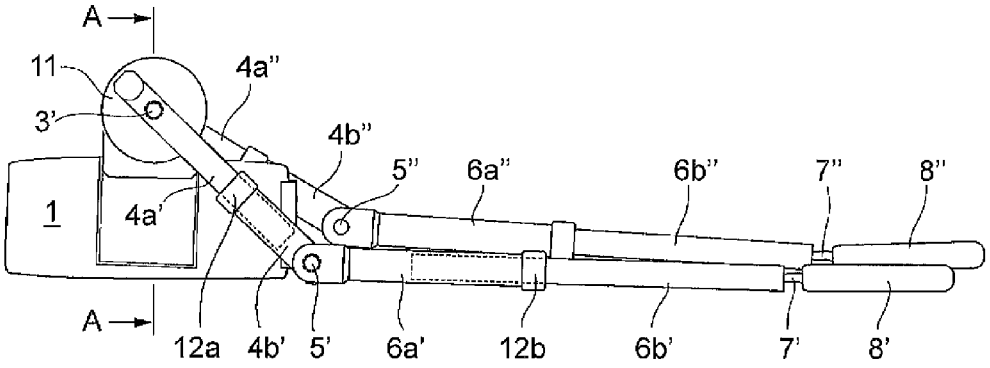
FIG. 3*a* shows the training equipment according to a first embodiment, in a side view.

FIG. 3*a* shows the training equipment according to one embodiment in detail. The waist belt 1 is adapted to be attached to the exercising person, an attachment portion 2 is connected to the waist belt 1. A first distance device 4*a*', 4*b*' is flexibly attached in the attachment portion by a first joint 3'. The first 4*a*'; 4*b*' distance device comprises according to the embodiment shown in FIG. 1 a second portion 4*b*' that is telescopically insertable in a first portion 4*a*', which enables adjustment of the length of the first 4*a*'; 4*b*' distance device, which for example is needed for adapting the training equipment to the exercising person. According to the embodiment shown in FIG. 3*a* the first distance device comprises a threaded tension device 12*a* which comprises threads adapted to fit with threads of a slightly conical portion of the second portion 4*b*' of the first distance device 4*a*'; 4*b*' so that the on-threading of the tension device 12*a* on the slightly conical portion of the second portion 4*b*' of the first distance device 4*a*'; 4*b*' locks the first portion 4*a*' in the second portion 4*b*'. The second portion 4*b*' of the first distance device 4*a*', 4*b*' is flexibly connected to a second distance device 6*a*'; 6*b*' via a second joint 5'. The second 6*a*'; 6*b*' distance device comprises according to the embodiment shown in FIG. 1, like the first distance device, a second portion 6*b*' which is telescopically insertable in a first portion 6*a*', which enables an adjustment of the length of the second 6*a*'; 6*b*' distance device. The first 4*a*; 4*b* and the second 6*a*; 6*b* distance device can for instance be made of a rigid polymeric material which can be reinforced with glass or carbon fiber, or be made of a metal, such as aluminium.

The training equipment further comprises a handle portion 8' which according to the embodiment shown in FIG. 1 is attached in the second portion 6*b*' of the second distance device by a flexible and/or elastic attachment device 7' adapted for enabling a natural hand position throughout the entire movement.

Figure 3B:
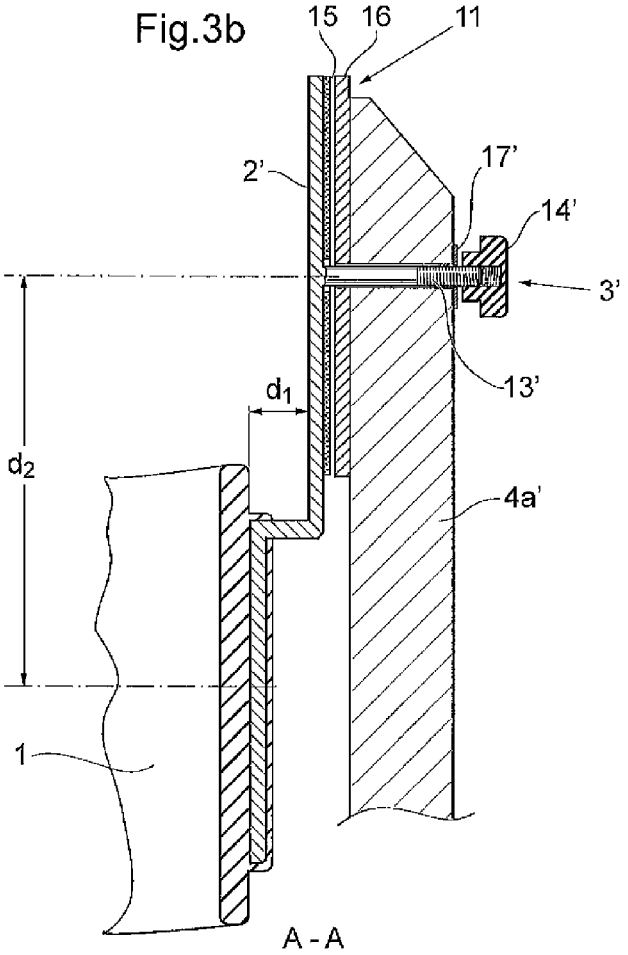
FIG. 3*b* shows a section view of the resistance device of a training equipment according to a first embodiment.

According to the embodiment shown in FIG. 3*a* the first joint 3 comprises an adjustable friction based movement resistance device (described more in detail with reference to FIG. 3*b*). The adjustable friction based movement resistance device is adapted to create a required resistance for achieving training of the upper body. The movement resistance device in the joint 3 can be replaced or supplemented with a movement resistance device placed in the second joint, such as friction based movement resistance device like the one described in relation to the first joint and/or friction and/or pressure-based movement resistance device placed in the first 4*a*; 4*b* and/or second 6*a*; 6*b* distance device.

FIG. 3*b* shows a sectional view of the movement resistance device 11 described with reference to FIG. 3*a*. The attachment portion 2' is fixed to the waist belt 1 at the lower portion of the attachment portion 2'. The attachment portion is adapted to place the joint 3' at a distance d1 from the body of the exercising person so that required distance is created for the movement needed for training of the upper body with the aid of the training equipment. Further, the attachment portion 2' is adapted for creating a distance d2 vertically from the waist belt to place the joint in a favorable position in relation to the waist belt 1. The first distance device 4*a*' is flexibly attached in the attachment portion 2' by a joint 3' comprising a shaft 13' attached to the attachment portion 2' and through-going the first distance device 4*a*' in a bushing 17'. The outer portion of the shaft 13 is threaded and adapted for a tension device 14' with a corresponding threading to be applied to the shaft and thereby lock the first distance device first portion 4*a*' to the shaft 13 and thereby to the attachment portion 2'. The joint 3 further comprises a movement resistance device 11 consisting of a first 15 disc attached in the attachment portion 2', and a second disc 16 attached in the first portion 4*a*' of the first distance device. The first 15 and the second 16 disc are adapted to abut against each other and with the aid of the friction between them create a movement resistance. The movement resistance between the first 15 and the second 16 disc can be adjusted by affecting the tension device 14' which presses the second disc 16 against the first disc 15. The adjustment of the movement resistance device 11 enables adaptation of the training to the exercising person, the training distance and/or the terrain in which the training is carried out. The tension device 14' can when required be supplemented with a resilient device which enables the creation of a constant pressing force on the discs 15; 16 and/or fixes the tension device 14' in a wanted position.

In alternative embodiments the movement resistance is adapted to vary over the movement which can be achieved by that the surfaces of the first 15 and/or second disc 16 are of different materials and/or structure, alternatively by that the surface of the disc is elevated and lowered respectively in a pattern that makes the contact between the discs vary over the movement of the discs 15; 16. Alternatively, the first (or second) disc is threadedly attached in the shaft 13 so that its pressure against the second (or first) disc varies as the thread pitch makes the pressure discs increase or decrease over the movement.

According to one embodiment the movement resistance device 11 only shows one resistance in the movement direction which corresponds to the forward poling, which for instance can be achieved by a ratchet function similar to the one present in a ratchet key, alternatively by that the surfaces of the discs 15; 16 have a scale structure which has a low friction in one direction and high friction in the opposite direction.

According to other embodiments, it can be desirable that the first distance device 4*a*; 4*b* rotates the entire turn around instead of carrying out a forward and backward movement. This can for instance be desirable when there is more of a technique element in the training.

Figure 4A:
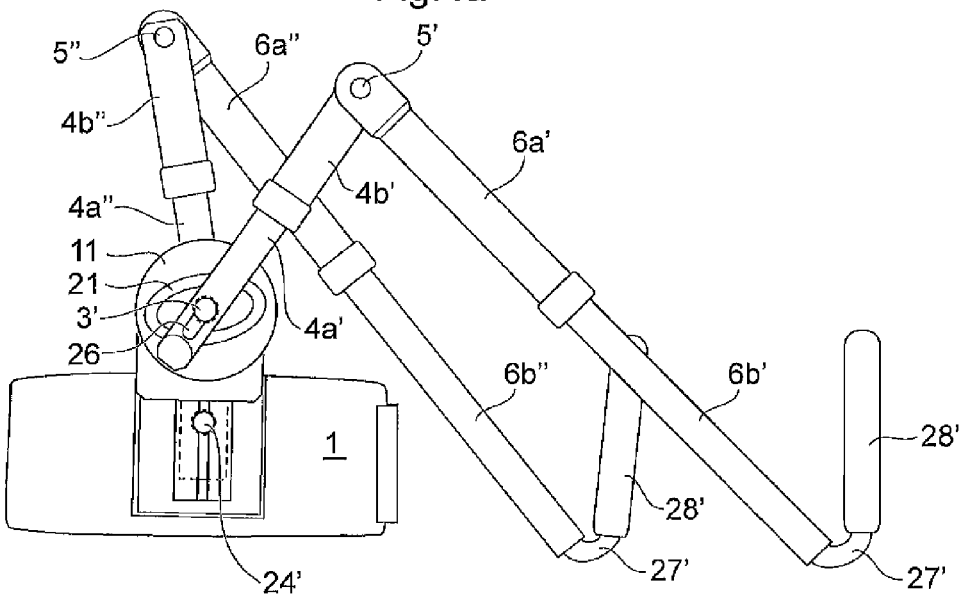
FIG. 4*a* shows the training equipment according to a second embodiment, in a side view.

FIG. 4*a* shows an alternative embodiment of the training equipment comprising the parts described with reference to FIG. 3*a*. The training equipment in the alternative embodiment shown in FIG. 4*a* further comprises an eccentric function, herein exemplified as an eccentric track 21 in which a cylindrical device (22 in FIG. 4*b*) is adapted to be arranged. The cylindrical device running in the elliptical track 21 is adapted to create an elliptical movement which propagates through the moving parts of the training equipment by that the first cylindrical device is attached in the first distance device 4*a*; 4*b*, which creates a reciprocating movement of the first distance device 4*a*; 4*b*. For the elliptical movement to propagate in a desired manner through the training device the attachment devices 27, by which the handle portions are attached, are rigid and thereby permit that the elliptical movement is reflected in the handle portions 28. The elliptical movement enables that the training equipment is used for specific technique training, such as specific stake technique training. The training equipment shown in FIG. 4*a* further shows a attachment portion 2' which is vertically adjustable by that the attachment portion 2' comprises a track 23' in which a shaft with a tension screw 24' is adapted to run, which enables adjustment of the attachment portion 2' vertically in relation to the waist belt 1 and fixation of the set position by the tightening of the tension screw 24'.

Figure 4B:
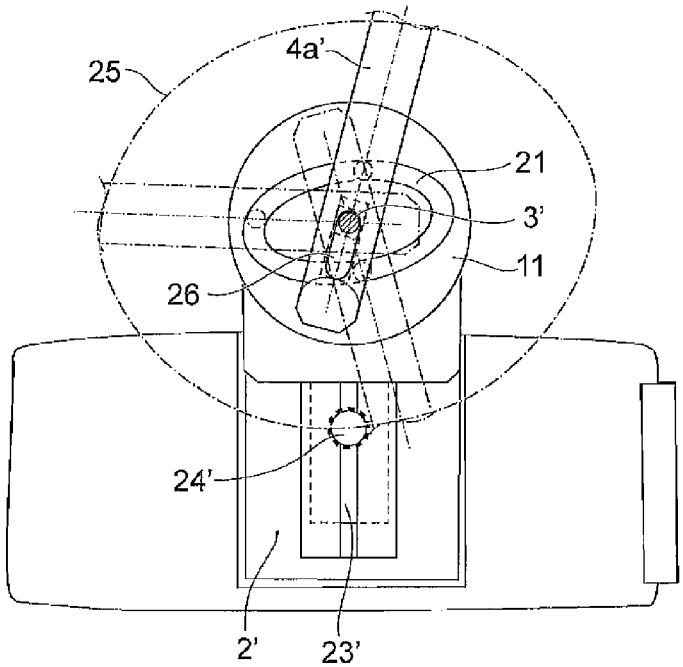
FIG. 4*b* shows the elliptical movement resistance of a training equipment according to a second embodiment.

FIG. 4*b* shows the elliptical movement resistance shown in FIG. 4*a* in further detail. The elliptical movement comprises a movement resistance device 11 in which an elliptical track 21 is arranged. The elliptical track 21 is adapted to receive a cylindrical device 22 attached in the first distance device 4*a*; 4*b* so that the cylindrical device 22 can slide in the elliptical track 21 which creates a reciprocating movement of the first distance device 4*a*; 4*b* since the first distance device 4*a*; 4*b* is reciprocally attached in the first distance device 4*a*; 4*b* by a track 21 in the first distance device 4*a*; 4*b* in which the shaft of the joint 3 is placed. The construction gives the first distance device 4*a*; 4*b* a reciprocating rotating movement when the first distance device is rotated around the joint 3'. The reciprocating rotating movement enables the use of the training equipment for technique training, such as stake technique training. The adjustable attachment portion 2' comprising a track 23' for a shaft with a tension screw 24' which enables adjustment of the attachment portion 2' vertically in relation to the waist belt. Adjustment of the attachment portion 2' and thereby of the joint 3' of the training equipment is essential for achieving optimal technique training since the track 25 (in the embodiment of FIG. 4*b* shown as an elliptical track 25) is highly dependent on the proportions of the exercising person (such as upper and lower arm length) and the the sought for training form.

Figure 4C:
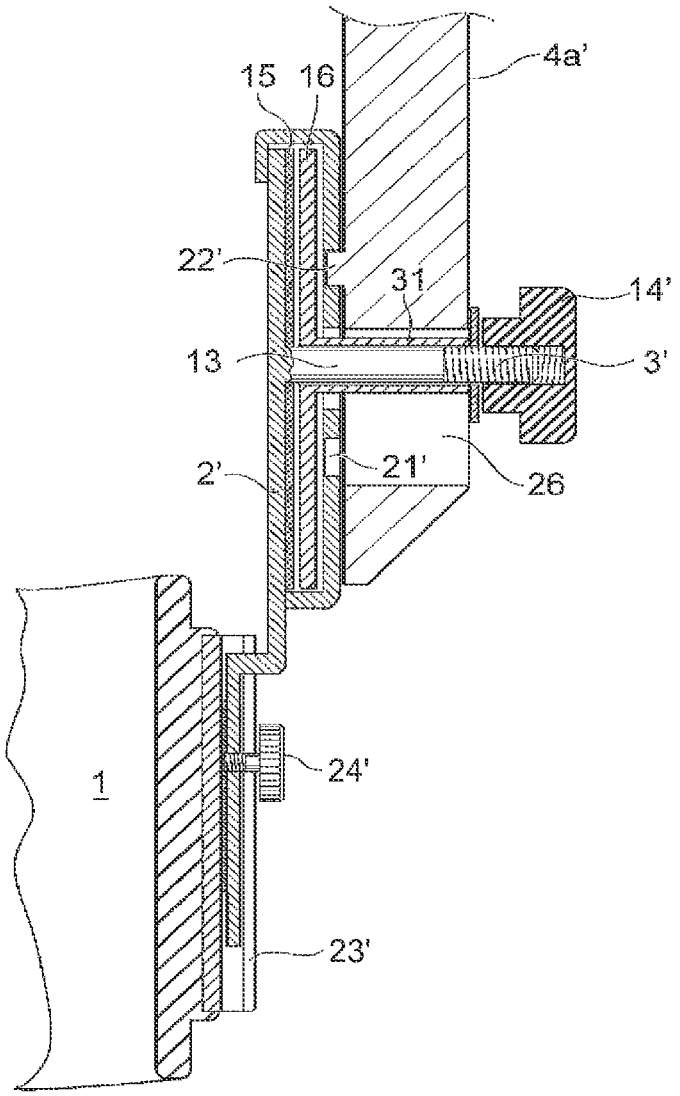
FIG. 4*c* shows a section view of the movement resistance device of a training equipment according to a second embodiment.

FIG. 4*c* shows a sectional view of the movement resistance device 11 described with reference to FIGS. 4*a* and 4*b*. The attachment portion 2' is adjustably attached to the waist belt 1 at the attachment portions 2' lower portion by that the attachment portion 2' comprises a track 23' in which a shaft with a tension screw 24' is adapted to run, which enables adjustment of the attachment portion 2' vertically in relation to the waist belt 1 and fixation of the set position by the tightening of the tension screw 24'. The attachment portion is adapted to place the joint 3' at a distance d1 from the exercising person so that required distance is created for the elliptical movement. The elliptical movement (shown in FIG. 4*b*) is created by an elliptical track 21' in the attachment portion 2'. The elliptical track 21 is adapted to receive a cylindrical device 22' attached in the first distance device 4*a*' so that the cylindrical device 22 can slide in the elliptical track 21 which creates a reciprocating rotating movement of the first distance device 4*a*; 4*b* when the distance device 4*a*; 4*b* is rotated around the rotation axis 3'.

The first distance device 4*a*; 4*b* is flexibly attached in the attachment portion 2' in a track 26 which allows sliding of the first distance device 4*a*; 4*b* in relation to the joint 3' which allows the reciprocating movement of the first distance device 4*a*; 4*b*. Further, the joint comprises a movement resistance device 11, a first disc 15 attached in the attachment portion 2', and a second disc 16 attached in a sleeve 31 in which the shaft 13 runs. The construction enables the pressing of the first disc 15 against the second disc 16 when the shaft 13 is pulled by the tensioning of the tension device 14' which creates the adjustable movement resistance. The adjustment of the movement resistance device 11 enables the adaptation of the training to the exercising person, the training distance and/or the terrain in which the training is carried out. The tension device 14' can when required be supplemented with a resilient device which enables the creation of a constant pressing force on the discs 15; 16 and/or fixes the tension device 14' in a wanted position.

Figure 5:
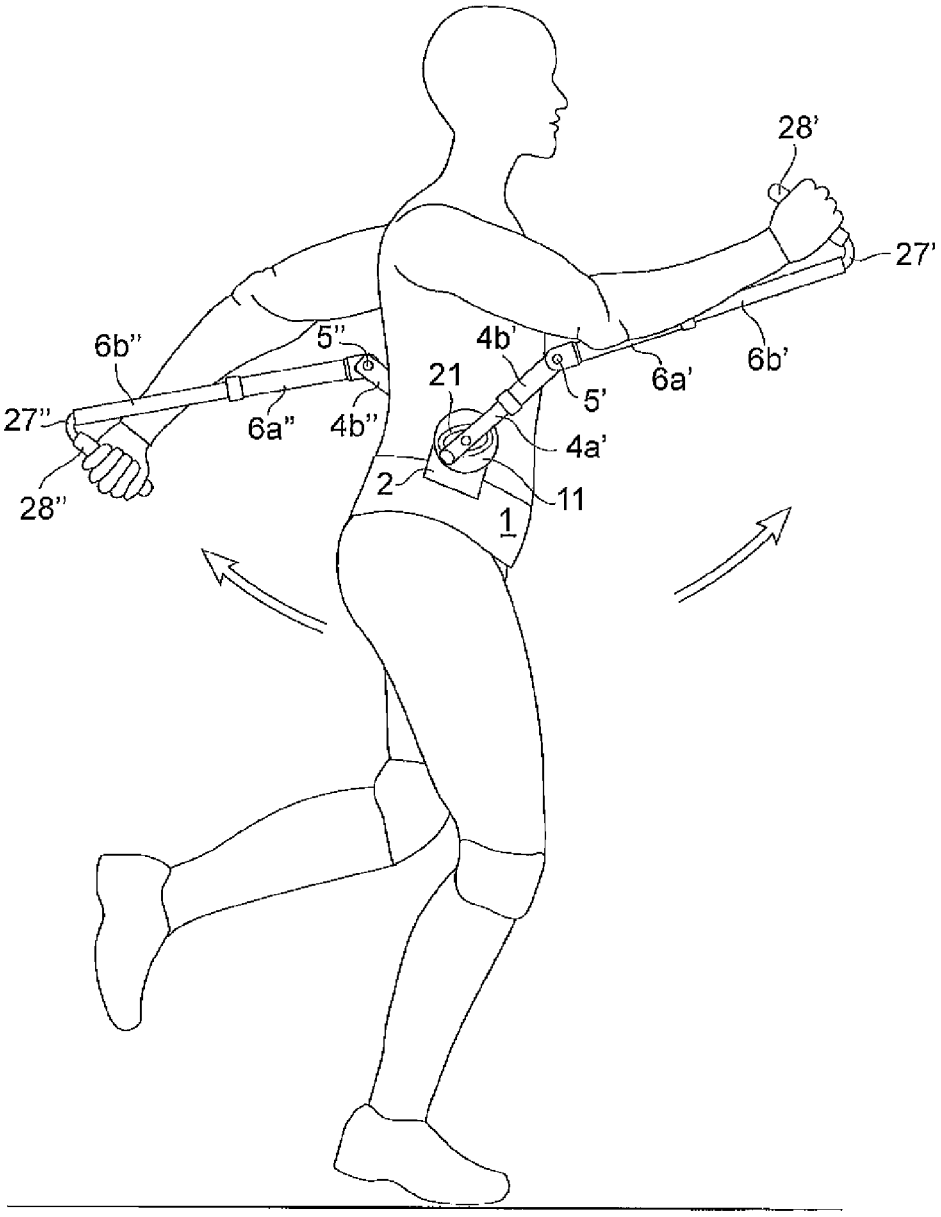
FIG. 5 shows the training equipment according to a second embodiment fixed to the waist of an exercising person in its second position.

FIG. 5 shows the training equipment described with reference to the FIG. 4*a*-4*c* when it is used by an exercising person. The elliptical tack 21 creates a reciprocating movement of the first distance device 4*a*; 4*b* which in the combination with the rotating movement makes the joint 5' move in an elliptical track in relation to the rotation axis attached in the attachment portion 2. The elliptical movement propagates through the training equipment and creates an elliptical movement pattern of the handle portion 28 by that the handle portion is fixedly attached in the second portion 6*b* of the second distance device 6*a*; 6*b* which leads to an effective simulation of the poling movement and hence a good poling training.

The description of embodiments above should not be seen as limiting but can be freely combined within the scope of the patent claims.

The invention claimed is:

1. A wearable training equipment for resistance training of the upper body, the wearable training equipment comprising:

an attachment portion configured for attaching to a waist belt that is attached to the body of an exercising person;

a first distance device rotatably connected to the attachment portion by a first joint, wherein the first joint is configured for creating a movement of the first distance device substantially parallel to the exercising person's median plane;

a second distance device rotatably connected to the first distance device by a second joint; and a handle portion connected to the second distance device, wherein the movement of the first distance device causes the handle portion to move between a forward direction and a backward direction;

wherein the first joint comprises an adjustable movement resistance device;

wherein the adjustable movement resistance device is adjustable between at least a first position and a second position;

wherein each of the first position and the second position of the adjustable movement device is configured to create a first resistance when the handle portion is moved in the forward direction and a second resistance when the handle portion is moved in the backward direction;

wherein the first resistance is resisting the movement of the handle portion in the forward direction and the second resistance is resisting the movement of the handle portion in the backward direction; and wherein the second resistance for the first position of the adjustable movement resistance device is greater than the first resistance for the first position of the adjustable movement resistance device, and wherein the second resistance for the second position of the adjustable movement resistance device is greater than the first resistance for the second position of the adjustable movement resistance device.

2. The training equipment of claim 1 further comprising a waist belt configured to be attached around the exercising person and wherein the attachment portion is attached to the waist belt.

3. The training equipment of claim 1 wherein a length of the first distance device is adjustable.

4. The training equipment of claim 1 wherein a length of the second distance device is adjustable.

5. The training equipment of claim 1 wherein the movement resistance device further comprises a friction based movement resistance device.

6. A wearable training equipment for resistance training of the upper body, the wearable training equipment comprising:

an attachment portion configured for attaching to a waist belt that is attached to the body of an exercising person;

a first distance device rotatably connected to the attachment portion by a first joint, wherein the first joint is configured for creating a movement of the first distance device substantially parallel to the exercising person's median plane;

a second distance device rotatably connected to the first distance device by a second joint; and a handle portion connected to the second distance device, wherein the movement of the first distance device causes the handle portion to move between a forward direction and a backward direction;

wherein the first joint comprises an adjustable movement resistance device;

wherein the adjustable movement resistance device is adjustable between at least a first position and a second position;

wherein the adjustable movement resistance device comprises a ratchet function such that each of the first position and the second position of the adjustable movement device is configured to create a first resistance when the handle portion is moved in the forward direction and a second resistance when the handle portion is moved in the backward direction;

wherein the first resistance is resisting the movement of the handle portion in the forward direction and the second resistance is resisting the movement of the handle portion in the backward direction; and wherein the second resistance for the first position of the adjustable movement resistance device is greater than the first resistance for the first position of the adjustable movement resistance device, and wherein the second resistance for the second position of the adjustable movement resistance device is greater than the first resistance for the second position of the adjustable movement resistance device.

7. The training equipment of claim 6 further comprising a waist belt configured to be attached around the exercising person and wherein the attachment portion is attached to the waist belt.

8. The training equipment of claim 6 wherein a length of the first distance device is adjustable.

9. The training equipment of claim 6 wherein a length of the second distance device is adjustable.

10. The training equipment of claim 6 wherein the movement resistance device further comprises a friction based movement resistance device.

* * * * *